United States Patent [19]

Vere

[11] 4,127,221

[45] Nov. 28, 1978

[54] CHILDPROOF DEVICE FOR CONTAINING AND DISPENSING FLUIDS

[75] Inventor: Mary A. Vere, Ridgewood, N.J.

[73] Assignee: Sterling Drug Inc., New York, N.Y.

[21] Appl. No.: 889,139

[22] Filed: Mar. 20, 1978

[51] Int. Cl.[2] ..... B65D 25/42

[52] U.S. Cl. ..... 222/153; 222/543; 215/214; 215/216; 215/224; 220/306; 220/375

[58] Field of Search ..... 215/214, 216, 217, 218, 215/224; 222/153, 543, 546; 220/306, 375

[56] References Cited

U.S. PATENT DOCUMENTS

| | | | |
|---|---|---|---|
| 3,869,057 | 3/1975 | Miller | 215/216 |
| 4,002,275 | 1/1977 | Crowle et al. | 215/216 X |
| 4,022,352 | 5/1977 | Fehr | 222/153 |
| 4,065,035 | 12/1977 | Eissler | 222/153 |

*Primary Examiner*—George T. Hall

*Attorney, Agent, or Firm*—Wenderoth, Lind & Ponack

[57] ABSTRACT

A childproof container and dispenser which is essentially a container, especially a container for holding a fluid therein, and a childproof cap fitted onto the neck of the container for dispensing the contents from the container and for preventing children from easily having access to the contents of the container. The cap has a base portion fitted onto the neck of the container with an orifice opening through the top surface thereof. The contents of the container are dispensed through this orifice. A first groove is formed around the top surface of the base portion. A top portion removably fits over the base portion in the first groove and also has an opening therethrough. There may be a hinge connecting the top portion and said base portion. A flexible upright locking lever which is continuously under tension extends upward from the top surface of the base portion through the opening in the top surface of the base portion through the opening in the top portion and engages the top portion when the top portion is fitted over the base portion. When the top portion is fitted over the base portion, the orifice opening is covered or closed.

17 Claims, 11 Drawing Figures

CHILDPROOF DEVICE FOR CONTAINING AND DISPENSING FLUIDS

The present invention relates to a container and a childproof cap which is to be attached to the container for dispensing the contents of the container.

BACKGROUND OF THE INVENTION

Many liquid substances are commonly found in the home today which can be extremely dangerous if used improperly and are equally dangerous if ingested or brought into contact with skin. A real danger also lies in the ease in which many of these substances may come into the hands of small children.

Numerous products and devices are currently available for containing these dangerous substances and at the same time hampering the ease with which the container may be opened. Many of the containers are especially designed to be childproof; some are very effective; some are not; and some are so effective that it is often difficult for an adult to open them.

SUMMARY OF THE INVENTION

It is, therefore, an object of the present invention to provide an improved childproof cap for a dispensing bottle and especially a liquid dispensing bottle, which is capable of inhibiting the opening of the container by children, and is at the same time not so difficult to open as to make it prohibitive for adults.

Furthermore, it is an object of the invention to provide a cap which may be easily produced using conventional injection molding techniques.

Also, it is an object of the invention to provide a safety cap which may be formed entirely as one piece and which may always be held on the container.

The cap of this invention has a top portion and a base portion which may be hinged together by an integral hinge. The base portion is designed to be securely held on a container holding a substance to be dispensed and act as the dispenser directing the outward flow of that substance. The bottom edge of the top portion fits into a groove around the top edge of the base portion and has a hole therethrough through which a locking lever connected to the base portion projects and is urged against the top portion. The locking lever is flexible and prevents the top portion from being raised from the base until it is moved toward the center of the opening in the top portion. Also, a plug or cover on the underside of the top portion closes a dispensing orifice in the top of the base portion when the top portion is closed over the base portion. A ridged portion is formed on the top portion to facilitate pushing the top portion upward and away from the base portion. To open the cap requires both an upward force against the top portion and simultaneously aligning the locking lever in the opening through the top portion so that the top portion can be lifted over the lever.

BRIEF DESCRIPTION OF THE DRAWINGS

Additional objects of the invention will be apparent in light of studying the formal drawings, wherein.

DETAILED DESCRIPTION OF THE INVENTION

The cap 1 of this invention is formed to have basically two parts, a top or closure portion 2 and a base portion 3. The top portion 2 and the base portion 3 may be connected by a hinge 4, and this is preferred. It is considered that the top and base portions as well as the hinge may be made of any standard flexible thermoplastic material, such as polyethylene, polypropylene or polyalomer.

Figure 2:
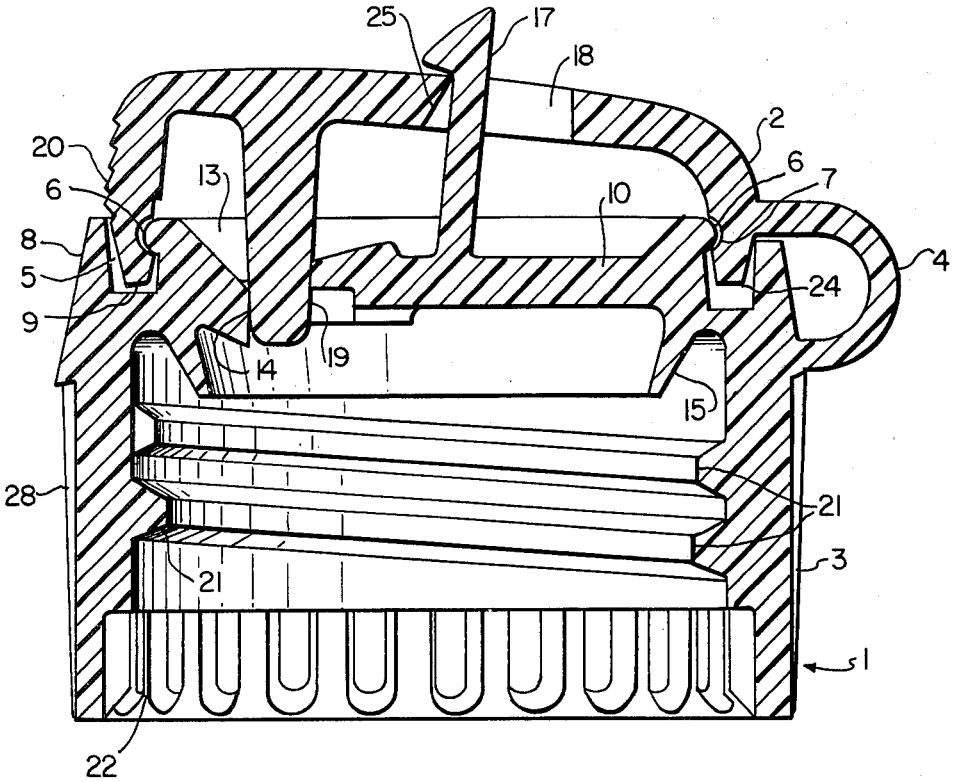
FIG. 2 is a side sectional view of the cap in the closed position.

FIG. 2 shows best the detailed construction of the top portion 2 and how the top portion is designed to be removably fitted into the base portion 3. A groove 5 is channelled around the inside edge of the top of the base portion 3. This groove 5 has a rim 6 around the inside wall thereof. The rim 6 is designed to fit into an additional channel 7 formed around the inside of the top portion 2. When the rim 6 is in the channel 7, the top portion 2 is locked within the groove 5. Furthermore, a special edge 8 is provided around the outside of the groove 5 and extends above the bottom edge 9 of the top portion; this edge 8 acts as a tooth guard to prevent children from getting their teeth under the top portion and also acts to prevent fingers from getting under the top portion and prying it loose. This edge around the groove preferably provides this safety feature around the entire cicumference of the cap between the top and base portions.

Through the top wall 10 of the base portion 3 is an orifice 11 through which the contents of the bottle to which the cap 1 is threaded may be dispensed. It can be seen in FIG. 2 that the top wall 10 has sides 13 which are angled and project above the top wall so that the upper surface thereof forms a saucer-shaped well, and one portion of the side 13 angles downward at 14 to form the orifice 11 at the lowest point of the well. It is, therefore, possible for any spillage through the orifice to drain back into the container when the container is uprighted.

Figure 4:
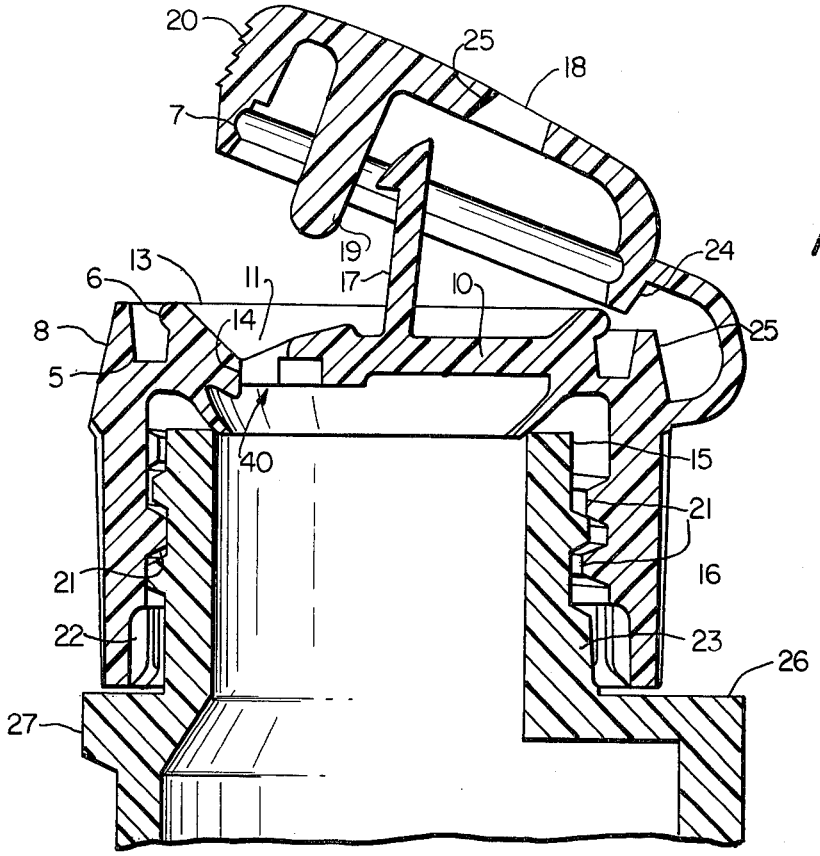
FIG. 4 is a side sectional view of the cap in the open position while it is threaded onto a container.
Figure 5A:
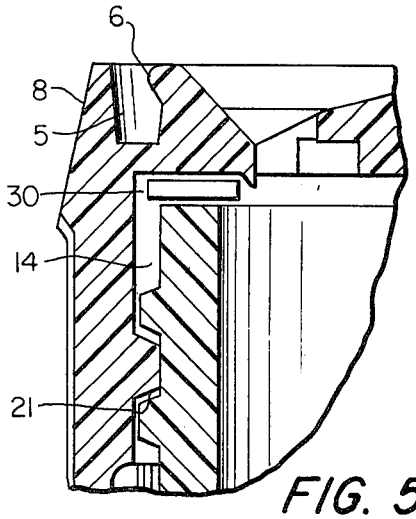
FIGS. 5*a*–5*e* show various types of sealing arrangements between the cap and the container.
Figure 5B:
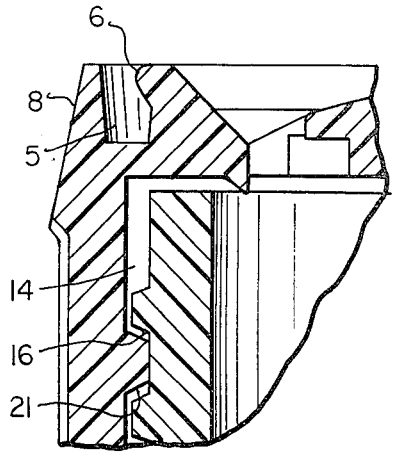
Figure 5C:
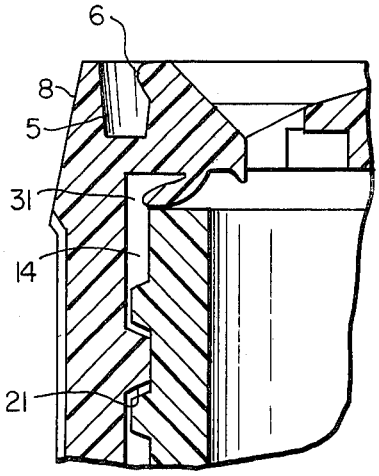
Figure 5D:
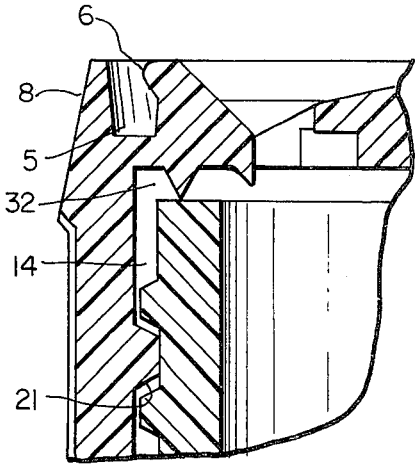
Figure 5E:
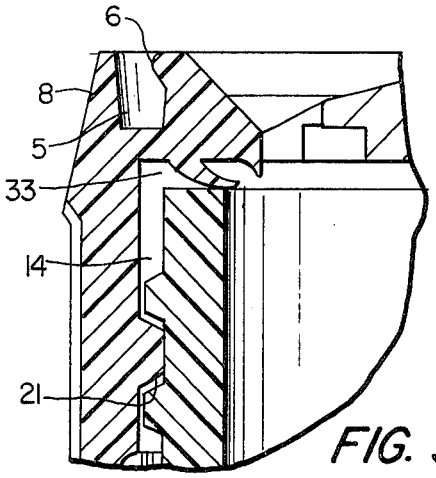
Figure 6:
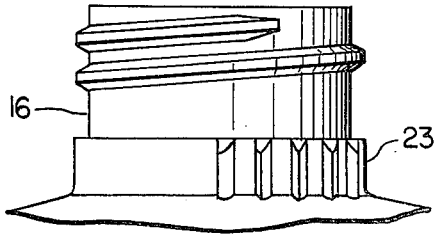
FIG. 6 shows the lock ratchet arrangement on the neck of the container.

Projecting downward from the bottom of the top wall 10 is a valve seal 15. FIG. 4 shows the valve seal 15 seated against the neck portion 16 of a container to which the cap is affixed, (the neck portion being joined to the body of the container). The valve seal 15 is flexible and integrally formed with the top wall 10 in this embodiment; however, by providing this specific valve seal 15, it is not intended that the sealing structure should be limited to this specific example. There are other seal arrangements, such as those shown in FIGS. 5*a*–5*e*. For example, a gasket or washer 30 may be positioned between the top surface of the neck portion of the container and a flat underside of the base portion 3 of the cap. (FIG. 5*a*). In addition to these gasket and valve seals, a land seal may be used (FIGS. 5*b*–5*e*). The neck portion 16 may butt against the cap directly (FIG. 5*b*) or variously shaped projections 31, 32, 33 may extend from the underside of the base portion against the neck portion to thereby seal the contents within the container (FIGS. 5*c*–5*e*).

Projecting directly upward from the top wall 10 is a locking lever 17. This lever member 17 is resilient and flexible and is designed to fit through an opening 18 in the top portion 2. The lever is pawl-shaped and forces against the top portion to prevent the top portion from moving upward. The lever member 17 is preferably integrally formed with the top wall, but other constructions are possible. Of importance, too, is the fact that the lever member 17 is positioned far enough in front of the opening 18 when the top portion is closed so that it will be continuously urged forward against the front edge of the opening. Therefore, it is necessary to specifically push the lever backward and hold it against the resilient force of the lever urging it forward and upright so that the top portion may be lifted over the lever without the edge of the opening catching on the lever.

Projecting from the bottom surface of the top portion 2 is a post or plug 19 which is of suitable length and diameter to fit through and close the orifice 11 when the top portion 2 is closed against the base portion 3. The plug 19 may be integrally formed with or subsequently attached to the top portion.

Figure 7:
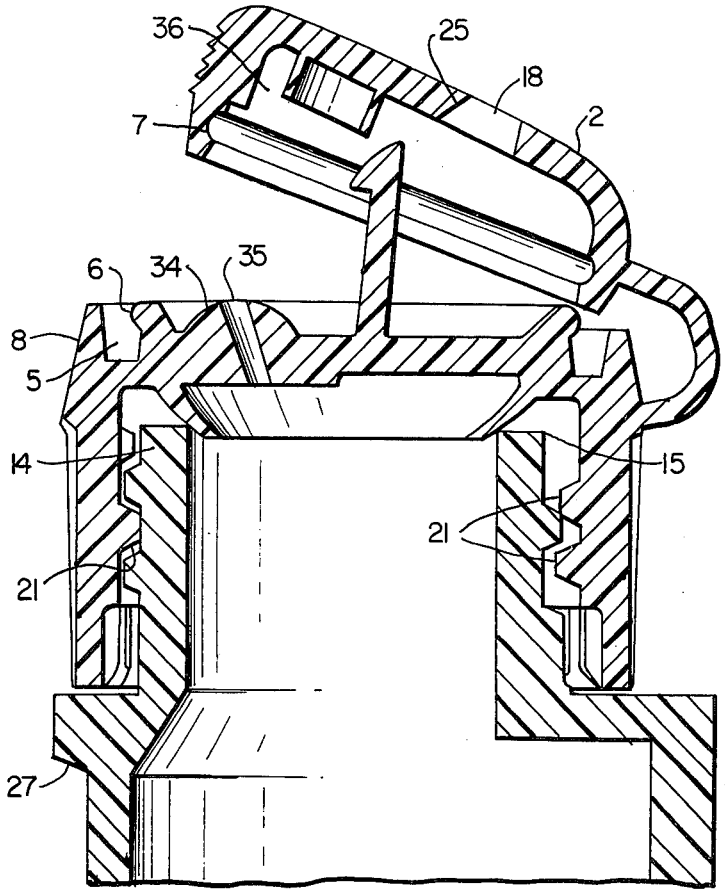
FIG. 7 shows a cup-type seal for closing the container dispensing orifice.

Even though the embodiment of the orifice-type opening represented in FIG. 2 is the preferred embodiment, FIG. 7 shows a second orifice configuration which is also adaptable to incorporating the locking lever member 17 therewith. This structure is commonly referred to as a cup-type seal and has a raised portion 34 which sits above the top wall 10 of the base portion and which has an orifice 35 therethrough so that the contents of the container may be dispensed. To seal this raised portion, a "cup" 36 suitably positioned on the underside of the top portion 2 fits over the raised portion when the top portion is fitted over the base portion.

Figure 1:
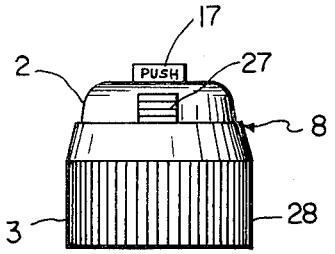
FIG. 1 is a front view of the cap in a closed condition.
Figure 3:
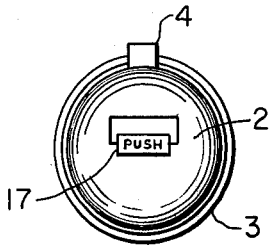
FIG. 3 is a top view of the cap in a closed position.

When the top portion 2 is closed over the base portion 3, as shown in FIG. 1, a ridged surface 20 of horizontal or reversed taper ridges is readily available at the front of the top portion for being pushed against to separate the top and base portions. The remaining edge surfaces of the top portion may then be somewhat rounded, if desired, to increase the difficulty in trying to push the top from the base — especially for a small child who may not realize the necessity of applying an upward force directly against this ridged surface 20.

To allow the particular cap 1 in this embodiment to be attached to the container 16, the base portion has threads 21 which are threaded onto corresponding threads around the neck or mouth 16 of the container. It is not, however, intended that this should be the only way to attach the cap to the container. For example, a ridge might simply be run around the inside of the base portion to snap-lock with a similar ridge on the neck of the container. Furthermore, any other conventional joining arrangement may be used.

In conjunction with the joining of the base portion 3 and the neck 16, an additional locking structure is provided in the form of a cap ratchet arrangement 22 around the inside top or bottom edge of the base portion. This cap ratchet structure 22 is designed to coordinate with an additional container ratchet structure 23 correspondingly positioned around the neck 16 of the container so as to engage the cap ratchet arrangement and prevent the possibility of removing the cap 1 by unthreading it from the container. When unthreading is attempted, the two sets of ratchets engage and prevent any further twisting motion.

It is pointed out above that a tooth guard 8 is formed as a result of providing the groove 5 which receives the lower edge of the top portion 2. This groove 5 further acts as a stabilizer when the top portion 2 is pushed upward at the ridged portion 20 by providing a back surface at 24 against which the rear edge of the top portion can pivot. Such a pivot point is necessary to prevent the back of the top portion from simply slipping backward when pressure is exerted against the front of the top portion at the ridged portion 20. Otherwise, if the top portion slipped backward, the upper surface of the top portion at the opening 18 therethrough would continuously slide underneath the lower surface of the lock lever 17. This would greatly hamper the ease and efficiency of opening the cap when such action is specifically desired. Therefore, even if the groove 5 is not provided deep enough to act as a true tooth guard, some channel or at least a pivot wall should be provided for the top portion to pivot against when the front of the top portion is pushed upward.

It should further be noted, as shown in FIG. 2, that the opening 18 in the top portion 2 may be any opening large enough to accomodate the passage of the locking lever 17 therethrough; however, by forming the forward surface of the opening with a slant surface 25, the slant surface of the locking lever 17 can easily slide therealong when the top portion is closed over the locking lever.

To further enhance the safety of a container 16 to which this cap 1 is fitted, the container may be provided with either a flat bottle shoulder 26 or a projecting collar segment 27 against which the bottom of the base portion 3 is positioned when the cap 1 is on the neck 16. Either of these structures will increase the difficulty for a child either trying to get his teeth or fingers under the cap to forcibly pry it from the container.

Instructions for opening the cap may also be incorporated into the structure during the molding process by providing an upward arrow 27 on the ridged portion 20 to indicate that the top portion 20 should be pushed upward at that point, and the slant surface of the lock lever 17 projecting through the opening 18 may indicate that the lever should be pushed or pressed.

Also, to facilitate positioning of the cap 1 onto the container, the outer surface of the base portion 3 may be provided with a plurality of vertical ridges or serrations 28. These ridges will make it easier to hold the base portion than might otherwise be possible if the surface were smooth.

To separate the top portion 2 from the base portion 3, the lever 17 is forced backward and held in place so that the pawl portion thereof is positioned totally inside the opening, and then the top portion is pushed upward at the ridged portion 20. Thus, essentially two distinct and nearly simultaneous motions are required to force the top away from the base and open the container. When the top is pivoted backward, the plug 19 is automatically withdrawn from the orifice 11 in the top wall 10 of the base portion or the cup is lifted away from the raised portion. Then, the contents of the container can be dispensed through the orifice 16.

The cap is closed simply by returning the hole 18 of the top portion over the lock lever 17 and pushing the top portion downward. This downward force forces the channel 7 around the rim 6 to lock the top on the base portion and allows the lever 17 to spring forward through the opening and also lock the top portion.

Finally, the underside of the top wall 10 of the base portion may be specially formed around the orifice 11 to facilitate and direct the flow of the contents through the orifice. Generally, a baffle 40 is provided which has a wall sloped at an angle of approximately 45°. This baffle causes the contents of the container to be dispensed from the container at an angle through the orifice by deflecting the contents before they exit through the orifice.

It will be apparent that various modifications may be made to the above specifically described structural arrangements without departing from the scope of this invention.

What is claimed is:

1. A childproof device for containing and dispensing a substance, said device comprising:

a container means for containing said substance therein, said container means being comprised of a body portion and a neck portion extending outward from said body portion; and childproof capping means fitted onto said neck portion of said container means for dispensing said substance from said container and for preventing children from having easy access to said substance in said container means, said capping means being comprised of:

a base portion fitted onto said neck portion, said base portion having an orifice opening through the top wall thereof through which the contents of said container means are dispensed and a groove around said top surface;

a top portion over said base portion and removably fitted into said groove, said top portion having an opening therethrough;

a flexible upright locking lever extending upward from said top wall of said base portion through said opening in said top portion and resiliently engaging said top portion when said top portion is fitted over said base portion; and closing means extending downward from said top portion for closing said orifice opening when said top portion is fitted over said base portion.

2. A device as claimed in claim 1, wherein:

said neck portion has threads on the outside thereof; and said base portion has threads on the inside thereof and is threaded onto said neck portion.

3. A device as claimed in claim 1, wherein:

said groove in said base portion has a protruding rim around the inside surface thereof;

said top portion has a channel around the inside thereof approximately the same size as said protruding rim; and said channel engages said rim when said top portion is fitted over said base portion.

4. A device as claimed in claim 1, further comprising a sealing means between the bottom of the top wall of said base portion and said neck portion for sealing said base portion in contact with said neck portion.

5. A device as claimed in claim 4, wherein said sealing means is a valve seal integrally formed with and extending downward from said top wall of said base portion.

6. A device as claimed in claim 1, wherein:

the upper surface of said top wall of said base portion surrounded by said groove is substantially saucer-shaped; and said orifice opening is at the lowest point within said saucer shape.

7. A device as claimed in claim 1, where the side surface of said base portion has vertical serrated ridges therearound.

8. A device as claimed in claim 1, wherein:

said locking lever has an angled locking member at the top thereof; and said opening in the top portion has a slanted forward surface angled substantially at the same angle as said angled locking number.

9. A device as claimed in claim 1, wherein said top portion has an area of horizontal ridges at the front thereof.

10. A device as claimed in claim 1, wherein said top portion has substantially rounded walls.

11. A device as claimed in claim 1, further comprising pivot bracing means at the rear wall of said base portion for allowing said top portion to pivot thereagainst when the front portion of said top portion is forced upward.

12. A device claimed in claim 1, wherein said capping means is comprised of flexible thermoplastic material selected from the group consisting of polyethylene, polypropylene and polyalomer.

13. A device as claimed in claim 1, further comprising locking means on said neck portion and on the inside of said base portion for locking said neck portion onto said base portion and thereby preventing removal of said base portion from said neck portion.

14. A device as claimed in claim 13, wherein said locking means is comprised of:

first lock ratchets on said neck portion; and second lock ratchets around the inside of said base portion engageable with said lock ratchets around said neck portion.

15. A device as claimed in claim 1, further comprising hinge means between said top portion and said base portion for holding said top and base portions together.

16. A device as claimed in claim 15, wherein said base portion, top portion, hinge means, locking lever and closing means are integrally formed together by injection molding.

17. A device as claimed in claim 1, wherein said closing means is comprised of a plug extending downward from said top portion and extending into said orifice when said top portion is fitted over said base portion.

* * * * *